United States Patent [19]

Orr

[11] 3,954,293

[45] May 4, 1976

[54] SELF-PROTECTING LATCH

[75] Inventor: Walton A. Orr, Niceville, Fla.

[73] Assignee: The United States of America as represented by the Secretary of the Air Force, Washington, D.C.

[22] Filed: Apr. 29, 1974

[21] Appl. No.: 465,221

[52] U.S. Cl. ..... 292/256.5; 292/68; 292/113; 292/DIG. 49

[51] Int. Cl.[2] ..... E05C 5/00; E05C 15/00; E05C 19/14

[58] Field of Search ..... 292/68, 113, 256.5, 292/DIG. 31, DIG. 49, 66

[56] References Cited

UNITED STATES PATENTS

| | | | |
|---|---|---|---|
| 1,118,768 | 11/1914 | Helgeson | 292/DIG. 49 |
| 2,732,238 | 1/1956 | Dornberg | 292/113 |
| 2,943,589 | 7/1960 | Lovell et al. | 292/256.5 |
| 2,991,108 | 7/1961 | Tantlinger | 292/256.5 |
| 3,021,162 | 2/1962 | Jahn | 292/DIG. 49 |
| 3,588,156 | 6/1971 | Bognar et al. | 292/256.5 X |
| 3,636,683 | 1/1972 | Francis et al. | 292/66 X |
| 3,873,142 | 3/1975 | Reid | 292/66 |

FOREIGN PATENTS OR APPLICATIONS

| | | | |
|---|---|---|---|
| 3,389 | 11/1904 | United Kingdom | 292/256.5 |
| 1,476,111 | 4/1967 | France | 292/68 |

*Primary Examiner*—Paul R. Gilliam
*Assistant Examiner*—Carl F. Pietruszka
*Attorney, Agent, or Firm*—Joseph E. Rusz; Sherman H. Goldman

[57] ABSTRACT

An improved latch for use on munition shipping containers or the like for operation with any commonly available tool which increases the mechanical advantage to provide high opening and closing forces while avoiding exposed easily damaged surfaces. The large exposed surfaces on presently available hand operated latches are eliminated thereby preventing damage resulting from accidental hooking on projecting surfaces and/or adjacent latches.

3 Claims, 2 Drawing Figures

SELF-PROTECTING LATCH

BACKGROUND OF THE INVENTION

This invention relates to an improved latching means and, more particularly, the invention is concerned with providing a self-protecting latch for use on a munitions shipping container wherein a removable lever is used to apply the latching forces.

Latches presently available are difficult or impossible to open and close by hand when they are tightened to the high bolt loads required to seal containers used to ship munitions or the like. Container opening and closing forces of 125 pounds have been measured on some containers presently in use. Either a makeshift tool such as a screwdriver, tire tool, etc., or a special tool is required in order to apply the forces necessary to operate the latches. The makeshift tools are difficult to use and can damage the latch, and the special tools are undesirable in so far as one must be furnished with each container.

Another drawback to the presently available latches which are designed to be opened and closed by hand is the presence of large exposed surfaces which function as handles. These handles are easily damaged by blows or by the accidental hooking of projections on adjacent containers. Thus, it can be seen that presently available latches are difficult and slow to open and close as well as being subject to easy damage by using makeshift tools or by accidentally hooking of projections on adjacent containers.

With the present invention the above-mentioned drawbacks can be avoided by eliminating the large exposed surfaces which tend to hook on the adjacent containers. Also, the present invention includes provisions whereby any commonly available tool can be inserted into the handle portion thereof so that a suitable force can be applied without causing damage to the latch itself.

SUMMARY OF THE INVENTION

The present invention provides an improved latch for use on an ammunition shipping container or the like and is characterized by having a removable lever and no projecting surfaces which would be apt to hook on adjacent containers. A pivotable lever element having a rod extending from one end thereof also includes a socket for receiving a removable handle. The lever element pivots in a channel member having parallel elongated flat side walls which effectively protect as well as engage a projection extending outwardly from the lever element. As the lever element is pivoted downward, the rod is drawn inward causing the part to which it is attached to be sealed against the other part which is attached to the channel member.

Accordingly, it is an object of this invention to provide a self-protecting latch which is sturdier than those presently available and avoids exposed easily damaged surfaces.

Another object of the invention is to provide an improved latch with a removable lever insertable in a handle. The latch is arranged so as to include guard sides which function to reinforce the handle and deflect blows on the latch.

Still another object of the invention is to provide an improved latch which is inherently stronger and more reliable than present latches. Any commonly available tool can be used to increase the mechanical advantage of the latch without any danger of causing damage thereto.

A further object of the invention is to provide an improved self-protecting latch wherein the unprotected surfaces on the hand operated latches are eliminated thereby preventing damage caused by hooking projecting elements on adjacent structures.

A still further object of the invention is to provide a latch that is quick and easy to open and close while being sturdy and capable of applying closing forces on the order of 125 pounds.

These and other objects, features, and advantages will become more apparent after considering the following description taken in conjunction with the annexed drawings and appended claims.

DESCRIPTION OF A PREFERRED EMBODIMENT

Figure 1:
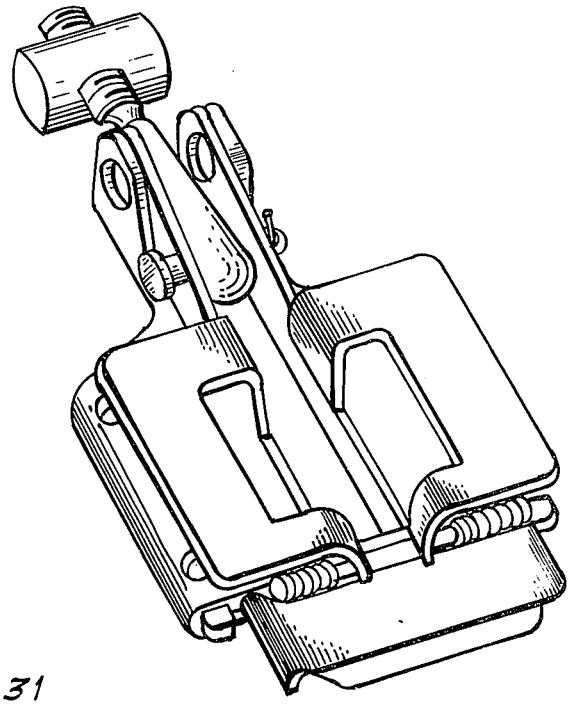
FIG. 1 PRIOR ART
FIG. 1 is a view in perspective of a prior art hand operated latch of the "butterfly" type showing the large exposed surfaces on the handles.

Referring now to the drawings, in FIG. 1 there is shown a view of the latch presently in use on munitions shipping containers. Latches of the type shown in FIG. 1 are difficult if not impossible to open and close by hand when they are tightened to the high bolt loads required to seal the munition containers. Opening and closing forces of 125 pounds have been measured on typical munitions shipping containers. A makeshift tool such as a screwdriver, tire tool, etc., or a special tool is normally required to operate the latch of FIG. 1. These makeshift tools are difficult to use and very often damage the latch, and the special tools are undesirable because one must necessarily be furnished with each container.

Figure 2:
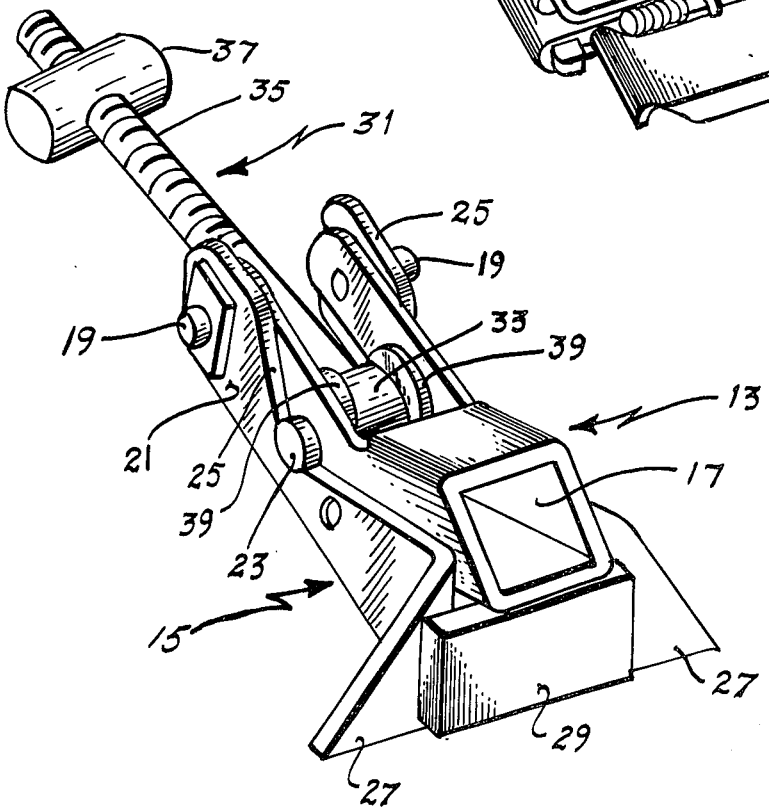
FIG. 2 is a view in perspective of the improved self-protecting latch according to the invention with the removable lever handle out of position and with the latch in the locked mode.

In the latch according to the invention as shown in FIG. 2, a screwdriver, tire tool or the like can be used in the opening or closing operations in a manner that leaves the latch undamaged. The latch includes two primary elements, a pivotable lever element 13 and a channel member 15. A socket 17 is provided in the forward portion of the lever element 13 for the purpose of receiving a removable lever handle (not shown). This handle may be any suitable tool such as, for example, a screwdriver, tire tool, etc. The rearward portion of the lever element 13 is arranged to pivot about the pivot pins 19 which pass through the side walls 21 of the channel member 15 near the rearward end thereof. A king pin 23 passes laterally through the central portion of the lever element 13 and projects outwardly beyond the sides thereof.

The channel member 15 includes parallel elongated side walls 21 with a contoured surface 25 on the upper edge thereof which engages the projecting portions of the king pin 23. The forward portion of the channel member 15 includes two outwardly extending ears 27 between which is positioned, by welding or other suitable means, a stop plate 29.

One end of a rod 31 is pivotably attached to the lever element 13 by means of an integral pivot eye 33 which fits over the king pin 23. The other end of the rod 31 includes the threads 35 on which a suitable fastening means 37 may be disposed. A pair of washers 39 are positioned between one on each side of the integral pivot eye 33 and the inner wall of the lever element 13 to provide bearing surfaces during the operation of the latch.

MODE OF OPERATION

In operation, the improved self-protecting latch is attached to an ammunition shipping container or the like by permanently affixing the channel member 15 to the body of the container by welding or some other suitable means. The fastening means 37 is then attached to the cover element by hooking around a suitable element thereon. Generally, a resilient gasket would be disposed between the cover and the edges of the body of the ammunition containers. At the time of hooking the lever element 13 is in the upward pivoted position and the fastening means 37 is threaded the proper distance on the rod 31.

Any suitable tool (not shown) is then inserted into the socket 17 and a downward or forward force is applied. This causes the lever element 13 to begin to pivot about the pins 19 while at the same time the integral pivot eye 33 is pivoting around the king pin 23. Upon further forward and downward movement of the lever element 13, the rod 31 is caused to be drawn inward until, finally, the lever element 13 reaches the stop plate 29 and the projections on the king pin 23 makes contact with the surface 25. At this point, the container is closed and sealed and the resilient gasket between the body and the cover would be suitably deformed to produce a fluid-tight joint. The lever (not shown) which was inserted in the socket 17 can then be removed and put aside for later use.

Thus, it can be seen that there has been disclosed a much improved self-protecting latch having a unique structure in which the lever element 13 fits down between the side walls 21 of the channel member 15 such that the latch is protected from blows which may inadvertently occur during normal handling of the ammunition containers. Also, since there are no projecting "butterfly" type handles, there is little or no chance of accidentally hooking adjacent containers or projections.

Although the invention has been illustrated in the accompanying drawings and described in the foregoing specification in terms of a preferred embodiment thereof, the invention is not limited to this embodiment or to the particular configuration mentioned. It will be apparent to those skilled in the art that other uses can be made of the hereinbefore described latch such as, hatch cover hold down and removable barrel head securing means and the like.

Having thus set forth and disclosed the nature of my invention, what I claim and desire to secure by Letters Patent of the United States is:

1. A self-protecting latch for use on an ammunition shipping container having a cover positioned on a body portion with a resilient gasket therebetween, said latch comprising, in combination, a pivotable lever element and a channel member attached to the body portion of the container, said lever element including a socket in the forward end thereof for receiving a removable lever handle, means for pivoting said lever element relative to said channel member, a king pin positioned laterally in the central portion of said lever element, said channel member having elongated parallel side walls, said king pin extending outwardly beyond the sides of said lever arm for engaging the upper edge of the side walls of said channel member, a rod having one end pivotally attached to said lever arm and extending rearwardly therefrom, the other end of said rod being attachable to the cover of the container, and an integral pivot eye on the inward end of said rod, said pivot eye being positioned to receive said king pin and be rotatable therearound, whereby the rotation of said pivotable lever element relative to said channel member causes said rod to be drawn inward with said pivot eye rotating on said king pin until the outward projections thereon contact the walls of said channel member thereby closing the cover and sealing the container by causing the resilient gasket to be suitably deformed.

2. The self-protecting latch defined in claim 1 wherein the means for pivoting said lever element includes a pair of pivot pins, one each through the side wall of said channel member at the rearward end thereof.

3. The self-protecting latch defined in claim 2 wherein a bearing means is positioned between each side of said integral pivot eye and the inner wall of said lever element for reducing the friction therebetween.

* * * * *